US010311844B1

(12) United States Patent
Godart

(10) Patent No.: US 10,311,844 B1
(45) Date of Patent: Jun. 4, 2019

(54) MUSICAL INSTRUMENT RECORDING SYSTEM

(71) Applicant: Peter T. Godart, Ridgewood, NJ (US)

(72) Inventor: Peter T. Godart, Ridgewood, NJ (US)

( * ) Notice: Subject to any disclaimer, the term of this patent is extended or adjusted under 35 U.S.C. 154(b) by 0 days.

(21) Appl. No.: 15/971,176

(22) Filed: May 4, 2018

(51) Int. Cl.
*G10H 1/00* (2006.01)

(52) U.S. Cl.
CPC ..... *G10H 1/0066* (2013.01); *G10H 1/0008* (2013.01); *G10H 2240/056* (2013.01)

(58) Field of Classification Search
CPC ..... G10H 1/0066; G10H 1/0008; G10H 2240/056
USPC ..... 84/645
See application file for complete search history.

(56) References Cited

U.S. PATENT DOCUMENTS 4,768,412 A * 9/1988 Sanderson ..... G10G 3/04 84/453
4,790,230 A * 12/1988 Sanderson ..... G10G 3/04 356/28
4,945,804 A * 8/1990 Farrand ..... G10G 3/04 84/462
5,054,360 A * 10/1991 Lisle ..... G10H 1/0066 84/645
5,410,100 A * 4/1995 Kim ..... G10H 1/0066 84/601
5,502,274 A * 3/1996 Hotz ..... G10H 1/0075 84/451
5,525,748 A * 6/1996 Kuribayashi ..... G10H 1/0041 84/602
5,541,359 A * 7/1996 Lee ..... G10H 1/0066 84/610
5,546,532 A * 8/1996 Trevett ..... G06F 9/30032 345/501
5,602,986 A * 2/1997 Trevett ..... G09G 5/39 345/502
5,611,064 A * 3/1997 Maund ..... G06F 12/1027 711/201
5,864,868 A * 1/1999 Contois ..... G07F 17/305
5,880,386 A * 3/1999 Wachi ..... G10H 1/0058 84/601

(Continued)

FOREIGN PATENT DOCUMENTS

CN 204720157 U 10/2015
CN 106409282 A 2/2017

(Continued)

OTHER PUBLICATIONS

International Search Report of the International Searching Authority dated Dec. 14, 2018, issued in connection with International Application No. PCT/US18/52823 (3 pages).

(Continued)

*Primary Examiner* — David S Warren
*Assistant Examiner* — Christina M Schreiber
(74) *Attorney, Agent, or Firm* — McCarter & English, LLP

(57) ABSTRACT

A musical instrument recording system is provided. The system includes a recorder capable of receiving MIDI data from an instrument and recording the MIDI data onto a first memory. The recorder further renders the MIDI data into an audio file and store the audio file onto a second memory as stored data. The recorder transmits the stored data to a user device, such as a user's smart phone, a remote computer, etc., and/or to a cloud-based storage system.

20 Claims, 7 Drawing Sheets

(56) References Cited

U.S. PATENT DOCUMENTS 5,883,957 A * 3/1999 Moline ..... G10H 1/0066 705/51
6,044,225 A * 3/2000 Spencer ..... G06F 13/124 710/52
6,067,566 A * 5/2000 Moline ..... G10H 1/0066 709/219
6,317,123 B1 * 11/2001 Moline ..... H04K 1/00 715/202
6,949,705 B2 * 9/2005 Furukawa ..... G10H 1/0041 84/610
6,989,485 B2 * 1/2006 Ochi ..... G10H 1/0066 705/51
7,276,655 B2 * 10/2007 Lin ..... G10H 7/02 84/603
7,371,959 B2 * 5/2008 Hiratsuka ..... G06F 21/10 705/51
8,338,686 B2 * 12/2012 Mann ..... G06F 3/0481 84/609
8,492,634 B2 * 7/2013 Savo ..... G06F 3/0481 84/610
8,785,760 B2 * 7/2014 Serletic ..... G06F 3/0481 381/119
9,390,696 B2 * 7/2016 Kiely ..... G11B 27/031
9,576,564 B2 * 2/2017 Yamauchi ..... G10G 3/04
2004/0055444 A1 * 3/2004 Ishii ..... G10H 1/0041 84/604
2004/0074377 A1 * 4/2004 Georges ..... G10H 1/0025 84/609
2004/0215958 A1 * 10/2004 Ellis ..... H04W 4/80 713/155
2009/0044686 A1 * 2/2009 Vasa ..... G06F 16/68 84/609
2011/0232462 A1 * 9/2011 David ..... G10H 1/0008 84/611
2012/0131146 A1 * 5/2012 Choi ..... H04L 65/4069 709/219
2015/0243180 A1 * 8/2015 Kim ..... G09B 7/00 434/362
2015/0302839 A1 * 10/2015 Georges ..... G10H 1/0066 84/645
2015/0364122 A1 * 12/2015 Ye ..... G10H 1/0016 84/174
2016/0335042 A1 * 11/2016 Belkhode ..... G06F 3/162
2018/0253492 A1 * 9/2018 Maggio ..... H04N 5/76
2018/0314465 A1 * 11/2018 Mittal ..... G06F 7/36

FOREIGN PATENT DOCUMENTS

CN 107146599 A 9/2017
KR 20160107910 A 9/2016

OTHER PUBLICATIONS

Written Opinion of the International Searching Authority dated Dec. 14, 2018, issued in connection with International Application No. PCT/US18/52823 (4 pages).

* cited by examiner

MUSICAL INSTRUMENT RECORDING SYSTEM

BACKGROUND

Technical Field

The present disclosure relates generally to the field of recording devices. More specifically, the present disclosure relates to a musical instrument recording system.

Related Art

Musical Instrument Digital Interface ("MIDI") is a technical standard describing a communications protocol, a digital interface, and electronic connectors that interconnect electronic musical instruments, computers, and other related music and audio devices. MIDI carries signals that specify notation, pitch, velocity (e.g., loudness and softness), volume parameters, and other signals between multiple devices. The signals are carried by a MIDI cable, which can carry multiple channels of information, each of which can be routed to a separate device. In an example, a MIDI keyboard can trigger another device (e.g., a sound module) to generate sound. Data relating to the sound (referred to as a "MIDI event") can be recorded using hardware and/or a software-based device, such as a sequencer, where a user can edit the data and play it back.

Current MIDI devices (e.g., sequencers) lack the ability to efficiently sort recorded MIDI events into tracks, automatically render the MIDI events into audio data/files, and provide an easy way for users to play back the MIDI events. Further, current MIDI devices lack capabilities to transfer the MIDI events wirelessly using a single, portable, easy-to-use device that can wirelessly communicate with remote devices such as remote computers, smart phones, etc. These and other needs are addressed by the musical instrument recording system of the present disclosure.

SUMMARY

This present disclosure relates to a musical instrument recording system. The system includes a portable, easy-to-use recorder that allows musicians, music educators, and other users to record and manage output from a MIDI-capable instrument. The recorder can connect to the instrument through a MIDI cable and record an incoming stream of MIDI data into volatile memory. When the recorder detects that the MIDI stream has been silent for a predetermined period of time (e.g., the user stops playing), the recorder renders the stream into audio data, stores the audio data and the MIDI data into non-volatile memory, and clears the volatile memory so that additional MIDI streams can be recorder. Further, the recorder automatically formats the MIDI stream in into one or more desired audio files such as MP3, FLAC, WAV, etc., and transmits the audio file and/or MIDI data to a user device, such as a smartphone, or to a remote server (e.g., a cloud-based storage system) for storage thereon. The recorder can also transmit the audio file and the MIDI data via to a remote device using a Bluetooth and/or WiFi transceiver built into the recorder.

BRIEF DESCRIPTION OF THE DRAWINGS

The foregoing features of the invention will be apparent from the following Detailed Description of the Invention, taken in connection with the accompanying drawings, in which.

DETAILED DESCRIPTION

The present disclosure relates to a musical instrument recording system, as described in detail below in connection with FIGS. 1-9.

Figure 1:
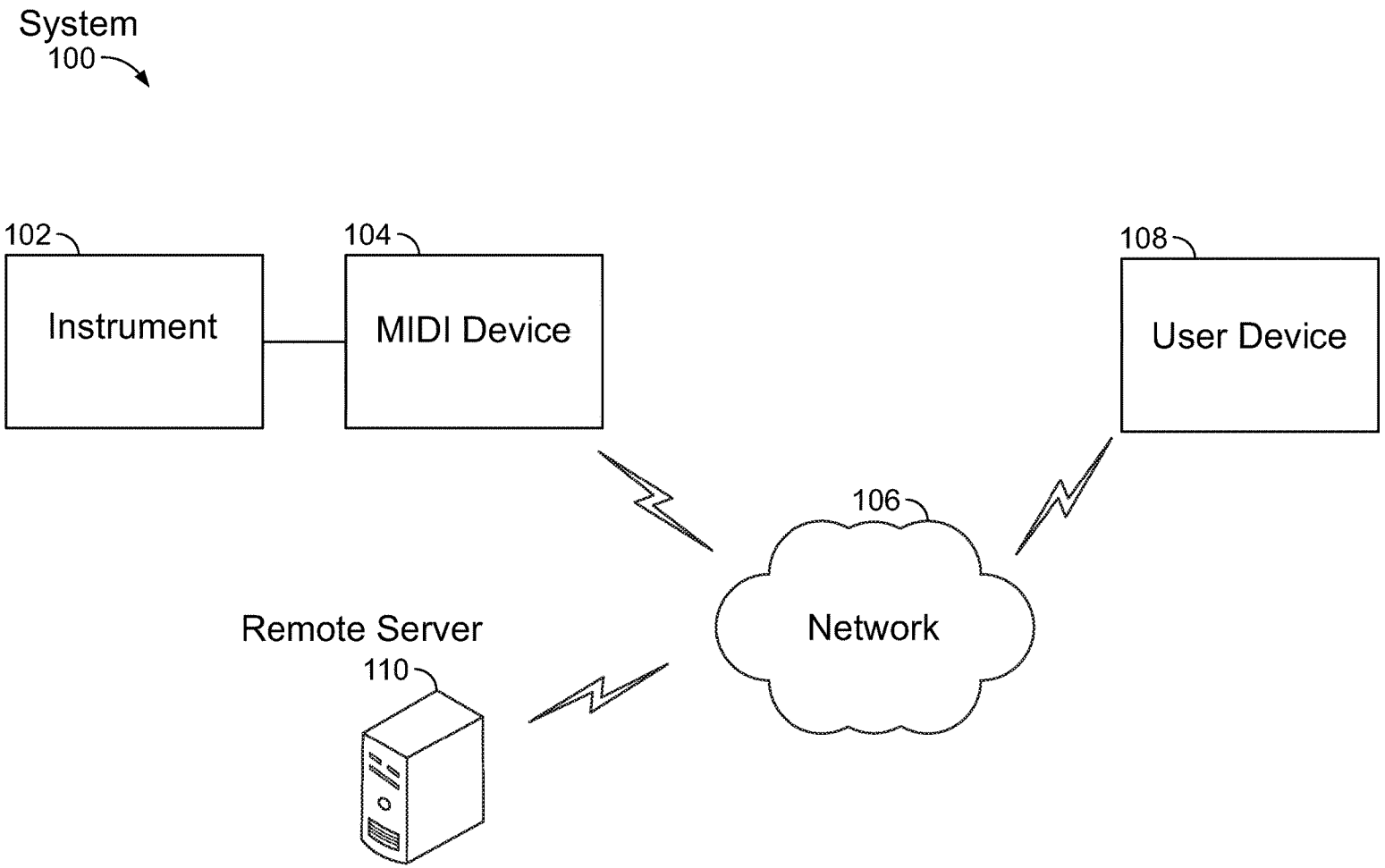
FIG. 1 is a diagram illustrating the musical instrument recording system of the present disclosure.

FIG. 1 is a diagram illustrating the musical instrument recording system, indicated generally at 100. The system includes a musical instrument 102, a musical instrument digital interface ("MIDI") device 104 (also referred to herein as a "recorder") and a user device 108 in communication with the recorder 104 via a network connection 106. The network connection 106 could include a wireless network connection (e.g., Bluetooth, WiFi, etc.), a local area network (LAN), a wide area network (WAN), the Internet, or a direct wired connection between the user device 108 and the recorder 104 (e.g., a wired universal serial bus (USB)) connection. Optionally, the recorder 104 could communicate with a remote server 110, which could include a cloud-based storage server/platform, remote computer system, etc. The instrument 102 can be any electronic musical instrument with MIDI capabilities, such as, for example, a MIDI keyboard, a Continuum Fingerboard, etc. The recorder 104 is capable of connecting to the instrument 102 and receiving data from the instrument 102 using a suitable MIDI electrical connection (e.g., using a MIDI interconnect cable). The connection between the instrument 102 and the recorder 104 can be wired or wireless. For example, the recorder 104 can be connected to the instrument 102 via a MIDI cable, a USB cable, a Bluetooth connection, or any other wired or wireless connection.

As noted above, the recorder 104 can communicate with the user device 108 directly (e.g., via a wired connection or a Bluetooth connection) or via the network 106. The network 106 can be any type of wired or wireless network, including but not limited to, a legacy radio access network ("RAN"), a Long Term Evolution radio access network ("LTE-RAN"), a wireless local area network ("WLAN"), such as a WiFi network, an Ethernet connection, or any other type network. The user device 108 can be any electronic device such as a mobile phone, a tablet computer, a smartphone, a phablet, an embedded device, a personal computer, a desktop computer, a wearable device, a field-programmable gate array ("FPGA"), an application-specific integrated circuit ("ASIC"), etc. The remote server 110 can be any type of server used for data storage, such as, for example, a cloud storage repository (e.g., Dropbox, Google Drive, etc.) The remote server 110 can receive data via the network 106 from the recorder 104 and/or the user device 108.

Figure 2:
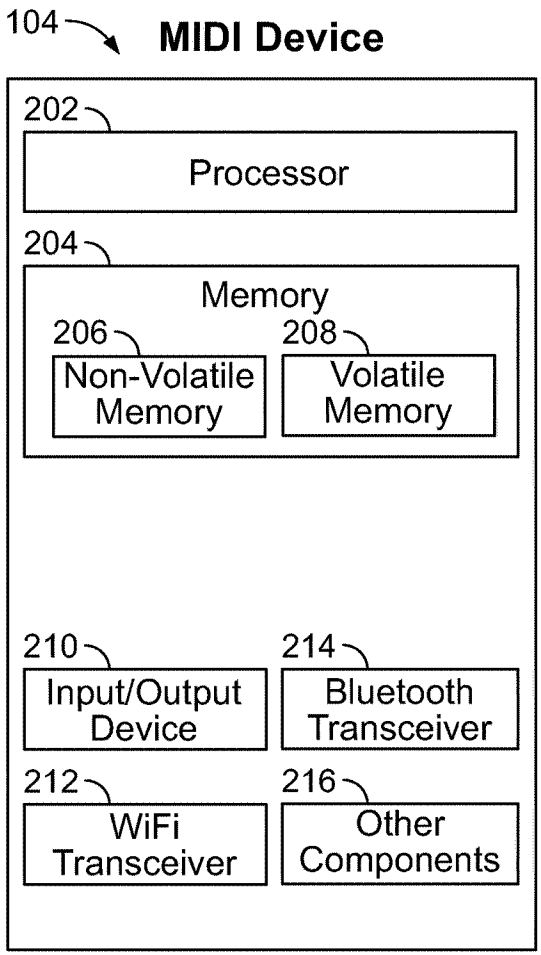
FIG. 2 is a diagram illustrating the hardware and software components of the recorder of the present disclosure.

FIG. 2 is a diagram illustrating components of the recorder 104. The recorder includes a processor 202, a memory 204, an input/output device 210, a WiFi transceiver 212, a Bluetooth transceiver 214, and other components 216. The processor 202 executes software/firmware modules for controlling the recorder 104, such as a WiFi connection module, a Bluetooth connection module, software/firmware for controlling recording of MIDI streams (as described in greater detail below), etc. The memory 204 can be a hardware component configured to store data related to operations performed by the recorder 104. Specifically, the memory 204 can store MIDI data received via a stream from the instrument 102. The memory can include any suitable, computer-readable storage medium such as a disk, non-volatile memory 206 (e.g., read-only memory ("ROM"), erasable programmable ROM ("EPROM"), electrically-erasable programmable ROM ("EEPROM"), flash memory, etc.), volatile memory 208, (e.g., random access memory ("RAM"), dynamic random-access memory ("DRAM"), etc.) or other types of storage media. The input/output device 210 is a hardware component that enables a user to enter inputs and display results, such as a display, touchscreen, etc.

The WiFi transceiver 212 could include any suitable, commercially-available transceiver configured to transmit and/or receive data via a WiFi frequency band, and which enables communication with other electronic devices directly or indirectly through a WiFi network based upon the operating frequency of the WiFi network. The Bluetooth transceiver 214 could include any suitable, commercially-available transceiver configured to transmit and/or receive data via a Bluetooth connection, and which enables communication with other electronic devices directly or indirectly through a Bluetooth connection based upon the operating frequency of the Bluetooth wireless technology standard.

The other components 216 can be a battery, a power port/cable, an audio output device, an audio input device, a data acquisition device, a USB port, one or more further ports to electronically connect to other electronic devices, a MIDI input port, a MIDI output port, etc. The MIDI output port can be used to playback MIDI data from the recorder 104. For example, the MIDI output port can be used to connect the recorder 104, via a suitable MIDI electrical connection (e.g., using a MIDI interconnect cable), to a speaker(s), a sound system, etc.

It should be noted that the recorder 104 can support a mesh network to connect a plurality of recorders or instruments to the user device 108. For example, the recorder 104 can act as a base node capable of handling data from one or more other nodes.

Figure 3:
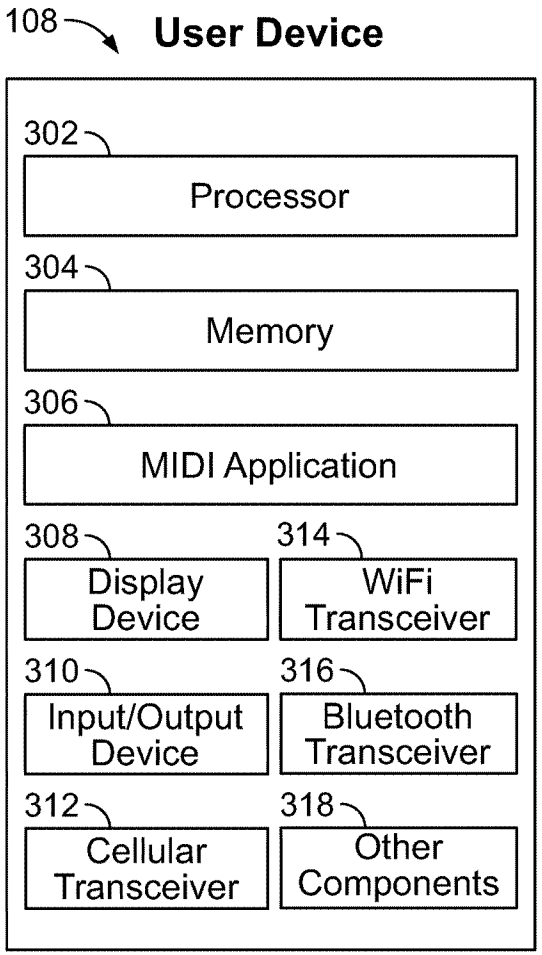
FIG. 3 is a diagram illustrating the hardware and software components of a user device (e.g., a smart phone) in communication with the recorder.

FIG. 3 is a diagram illustrating the user device 108. As discussed above, the user device can be a portable device such as a smartphone, a laptop, a tablet, etc., or a stationary device such as a desktop terminal. The user device 108 includes a processor 302, a memory 304, a MIDI application 306 which is stored in the memory 304 and executed by the processor 302, an input/output device 310, a cellular transceiver 312, a WiFi transceiver 314, a Bluetooth transceiver 316, and other components 318. The processor 302 can be configured to execute one or more applications of the user device 108. For example, the applications can include a web browser, the MIDI application 306, etc. The memory 304 can be a hardware component configured to store data related to operations performed by the recorder 104. For example, the memory 204 can store data received from the recorder 104. The memory can include any suitable, computer-readable storage medium such as a disk, non-volatile memory (e.g., read-only memory ("ROM"), erasable programmable ROM ("EPROM"), electrically-erasable programmable ROM ("EEPROM"), flash memory, etc.), volatile memory, (e.g., random access memory ("RAM"), dynamic random-access memory ("DRAM"), etc.) or other types of storage media.

The MIDI application 306 is a software application ("app") that can connect the user device 108 to the recorder 104 via, for example, a Bluetooth or a WiFi wireless connection. The MIDI application 106 can also perform other functions, such as initiate a connection pairing, receive user inputs, transmit the user inputs to the recorder 104, receive data from the recorder 104, manage the data, change parameters of the recorder 104 or the MIDI application 106, play back audio files received from the recorder 104, etc. These functions will be explained in greater detail below.

The display device 308 can be a hardware component configured to show data to a user. The input/output device 310 can be a hardware component that enables the user to enter inputs. The display device 308 and the input/output device can be separate components or integrated together, such as a touchscreen.

The cellular transceiver 312 is a hardware component configured to transmit and/or receive data via a cellular connection. Specifically, the cellular transceiver 312 enables communication with other electronic devices directly or indirectly through a cellular network (e.g., an LTE network, a legacy network, etc.) based upon the operating frequency of the cellular network.

The WiFi transceiver 314 could include any suitable, commercially-available transceiver configured to transmit and/or receive data via a WiFi frequency band, and which enables communication with other electronic devices directly or indirectly through a WiFi network based upon the operating frequency of the WiFi network. The Bluetooth transceiver 214 could include any suitable, commercially-available transceiver configured to transmit and/or receive data via a Bluetooth connection, and which enables communication with other electronic devices directly or indirectly through a Bluetooth connection based upon the operating frequency of the Bluetooth wireless technology standard.

The other components 318 can include a battery, an audio output device, an audio input device, a data acquisition device, one or more ports to electronically connect to other electronic devices, etc. The process steps of the invention disclosed herein could be embodied as computer-readable software/firmware code executed by the recorder 104 and/or the user device 108, and could be programmed using any suitable programming languages including, but not limited to, C, C++, C#, Java, Python or any other suitable language without departing from the spirit or scope of the present disclosure.

Figure 4:
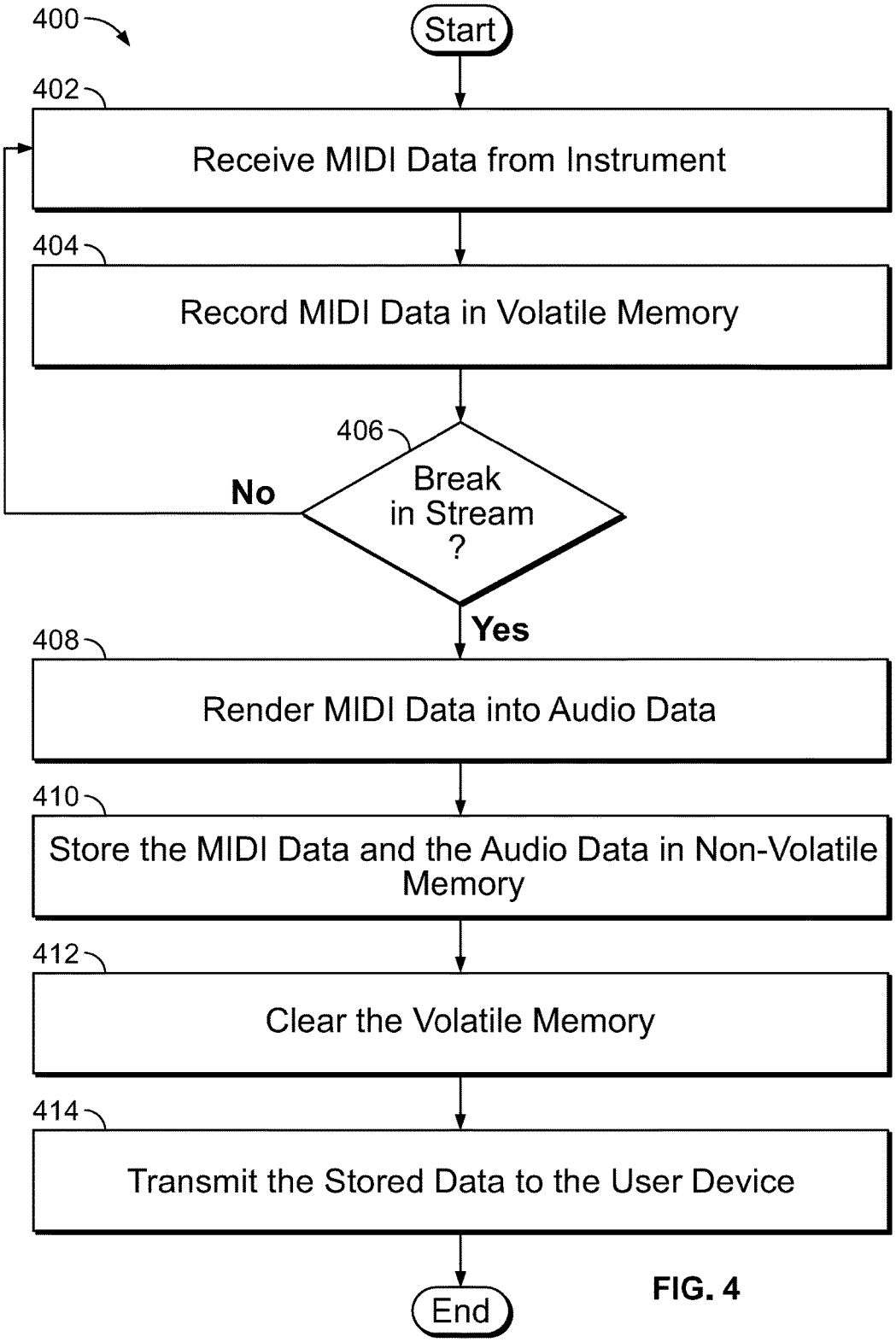
FIG. 4 is a flowchart illustrating process steps carried out by the recorder of the present disclosure.

FIG. 4 is a flowchart illustrating process steps carried out by the recorder 104 of the present disclosure, indicated generally at 400. In step 402, the recorder 104 receives MIDI data from the instrument 102. As discussed above, the recorder 104 can be connected to the instrument 102 via a wired or a wireless connection. In step 404, the recorder 104 records MIDI data via a stream from the instrument 102 onto the memory 204. Specifically, the recorder 104 can record the MIDI data onto the volatile memory 208. In step 406, the recorder 104 determines if there is a break in the stream from the instrument 102. The break can be a silence duration during which no data is received from the instrument 102 (e.g., the user ceased playing). The silence duration can be a predetermined duration or a user-selected duration. For example, a user can set or change the silence duration via the MIDI application 306. When there is no break in the stream, the recorder 104 returns to step 402. When there is a break in the stream, the recorder 104 proceeds to step 408.

In another embodiment of step 406, the recorder 104 can determine whether a stream exceeds a predetermined track duration. For example, the predetermined track duration can be 30 seconds. When the stream exceeds 30 seconds, the recorder 104 proceeds to, both, step 408 and step 402, regardless of whether there is a break in the stream. Specifically, MIDI data from the 30 second stream can proceed to step 408 while the recorder 104 also execute steps 402-406 for new MIDI data received from the instrument 102. As will be explained in further detail below, the predetermined track duration can be adjusted by the user. Further, those skilled in the art would understand that the predetermined track duration can be any period of time or any predetermined data size (e.g., 1 MB).

In step 408, the recorder 104 renders the MIDI data into audio data. For example, the recorder 104 can convert the MIDI data into an audio file format, such as, for example, an MP3 format or a WAV format. Those skilled in the art would understand that the recorder 104 can render the MIDI data into any audio format or any other format that can be used for storage, transfer, compression, identification, or other purposes. The user can select an upload format or a default soundfont to be used for rendering the MIDI data into audio data.

In step 410, the recorder 104 stores the MIDI data and/or audio data onto the non-volatile memory 206. In step 412, the recorder 104 clears the volatile memory 208 (e.g., clears the buffer). In step 414, the recorder 104 transmits the stored data to the user device 108. For example, if the user device 108 is paired to the recorder 104 via a Bluetooth connection or a WiFi connection, the recorder 104 can transmit the stored data to the user device 108 on the appropriate channel or band as outlined by the protocols of the wireless connection. The stored data can include the MIDI data, the audio data, and/or any other data (e.g., metadata). It should be noted that the user device 108 can also render the MIDI data into audio data (e.g., MP3 format, WAV format, etc.). For example, if the user elects for the recorder 104 to only store and transmit MIDI data to the user device 108, the user device 108 is capable of rendering the received MIDI data into audio data.

If the recorder 104 is not connected to or paired with the user device, the recorder 104 can store the data until a connection or a pairing is performed with the user device 108. In another embodiment, the recorder 104 can transmit the data to the remote server 110. After the data has been transmitted to the user device 108 or the remote server 110, the recorder 104 can delete the data from the non-volatile memory 206. Alternatively, the recorder 104 can maintain the data in the non-volatile memory 206 until a user input or predetermined condition occurs. The predetermined condition can include reaching a storage capacity threshold value, exceeding a time duration, etc.

Figure 5:
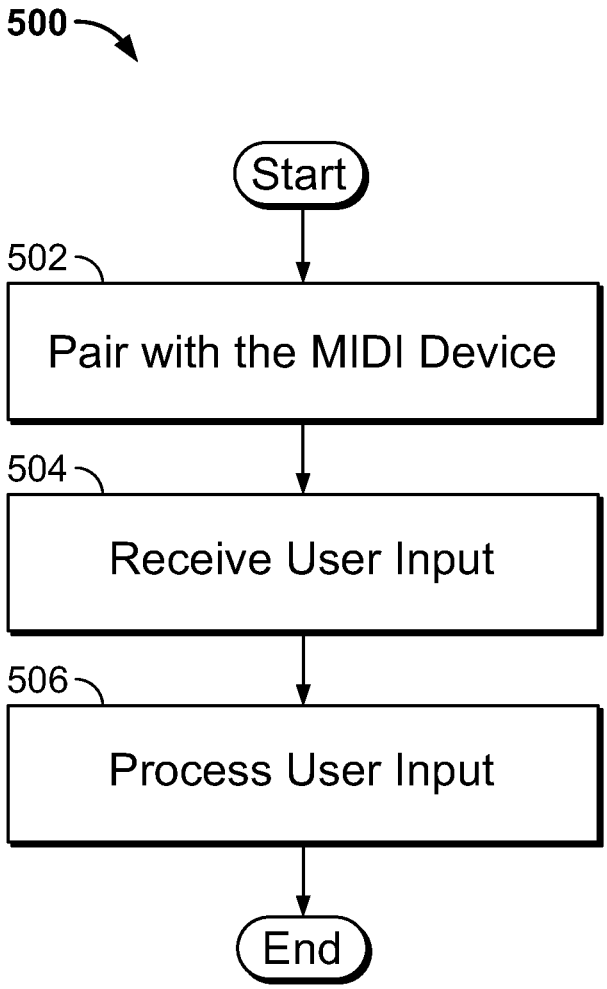
FIG. 5 is a flowchart illustrating process steps carried out by the user device of the present disclosure.

FIG. 5 is a flowchart illustrating process steps carried out by the user device 108 of the present disclosure, indicated generally at 500. In step 502, the user device 108 pairs with the recorder 104. As discussed above, the user device 108 can pair with the recorder 104 via a Bluetooth or a WiFi connection. The user device 108 can pair with the recorder 104 via a wired or other wireless connection. In step 504, the user device 108 receives a user input. In a first example, the user input is a request for the MIDI data and/or the audio data from the recorder 104. In a second example, the user input is a change in one or more parameters/settings relating to the recorder 104 or the MIDI application 306. The parameters/settings can relate to data collection processes, a data/sample rate settings, WiFi network options/identifications/passwords, an IP address, a maximum track duration, remote server options (e.g., storage destination, account settings, etc.), memory storage size (e.g., a maximum size for storing on the non-volatile memory 206, volatile memory 208, and/or the memory 304), a rendered audio format (e.g., MP3, WAV, etc.), a soundfont, a quality type, etc. Other examples of the parameters/settings can include options such as allowing the recorder 104 to use a cellular network of the user device 108 to upload the MIDI data and/or audio data to the remote server 110, changing setting related to the Bluetooth connection or the WiFi connection, transferring the MIDI data and/or audio data to a further device, changing a PIN, etc. In step 506, the user device 108 processes the user input. For example, if the user input includes user changing the rendering audio format of the recorder 104 (e.g., from MP3 to WAV), the user device 108 can transmit a signal instructing the recorder 104 to change the rendering audio format.

In an embodiment, the user device 108 can transmit MIDI data to the recorder 104. The user can then playback the MIDI data on the recorder 104. For example, the user can connect the recorder 104 to a sound system via the MIDI out port to playback the MIDI data.

Figure 6B:
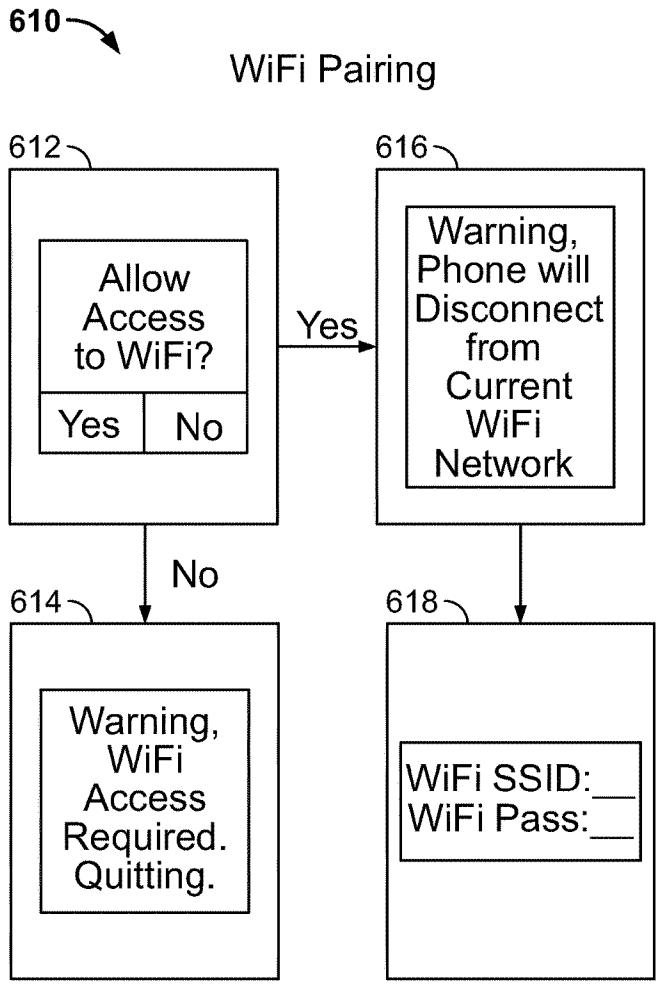
FIGS. 6A-6B are diagrams illustrating user interface screens generated by the user device for allowing Bluetooth and/or WiFi pairing of the recorder with a user device (e.g., a smart phone)
Figure 6A:
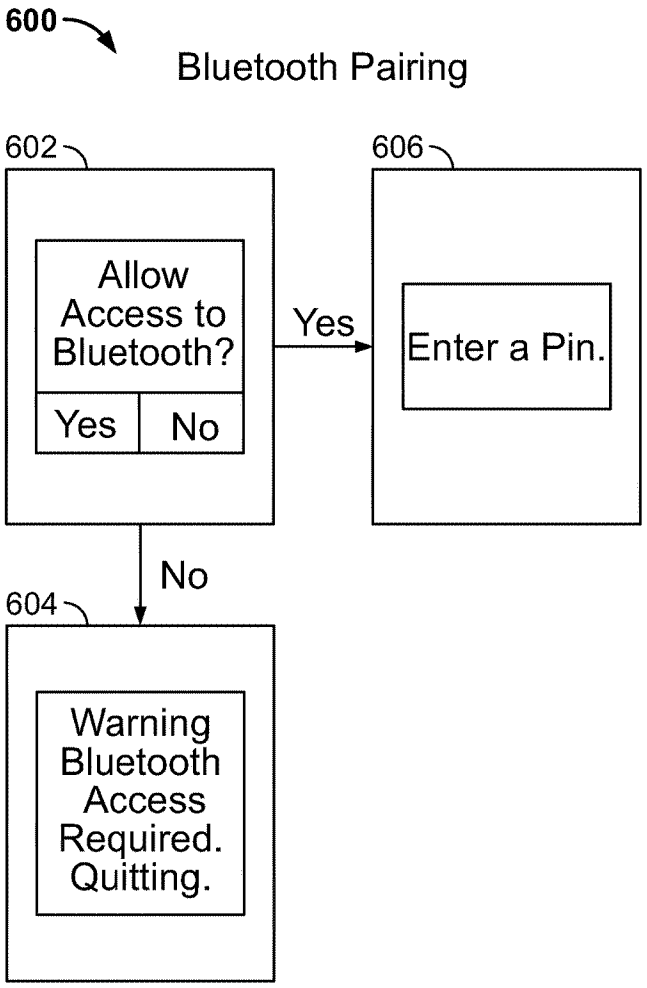

FIG. 6A illustrates user interface screens, indicated generally at 600, for allowing Bluetooth pairing between the recorder 104 and the user device 108. In step 602, the user is prompted with a message requesting access to the Bluetooth transceiver 316. When the user denies access to the Bluetooth transceiver 316, the Bluetooth pairing proceeds to step 604, where the user is notified that Bluetooth access is required. The MIDI application 306 can then exit and close. When the user allows access to the Bluetooth transceiver 316, the Bluetooth pairing proceeds to step 606, where the user is prompted to enter a PIN. The PIN can be for identification purposes, for security purposes, or for other purposes. The pin can initially be set to "0000" and the user can be prompted to change the PIN during an initial use. Those skilled in the art would understand that a PIN can be disabled or omitted from the MIDI application 306.

FIG. 6B illustrates user interface screens, indicated generally at 610, for allowing WiFi pairing between the Recorder 104 and the user device 108. In step 612, the user is prompted with a message asking the user to allow access to the WiFi transceiver 314. When the user denies access to the WiFi transceiver 314, the WiFi pairing proceeds to step 614, where the user is notified that WiFi access is required. The MIDI application 306 can then exit and close. When the user allows access to the WiFi transceiver 314, the WiFi pairing proceeds to step 616, where the user is notified that the user device 108 will be disconnected from a current WiFi network. The user can also be notified of a disconnection of the WiFi network between the user device 108 and the recorder 104. In step 618, the user is prompted for the WiFi network's service set identifier ("SSID") and password.

Those skilled in the art understand that the pairing method disclosed in FIGS. 6A and 6B are only examples. Other pairing methods that include any, all or none of the functions discussed above can also be used to connect or pair the user device 108 to the recorder 104.

Figure 7:
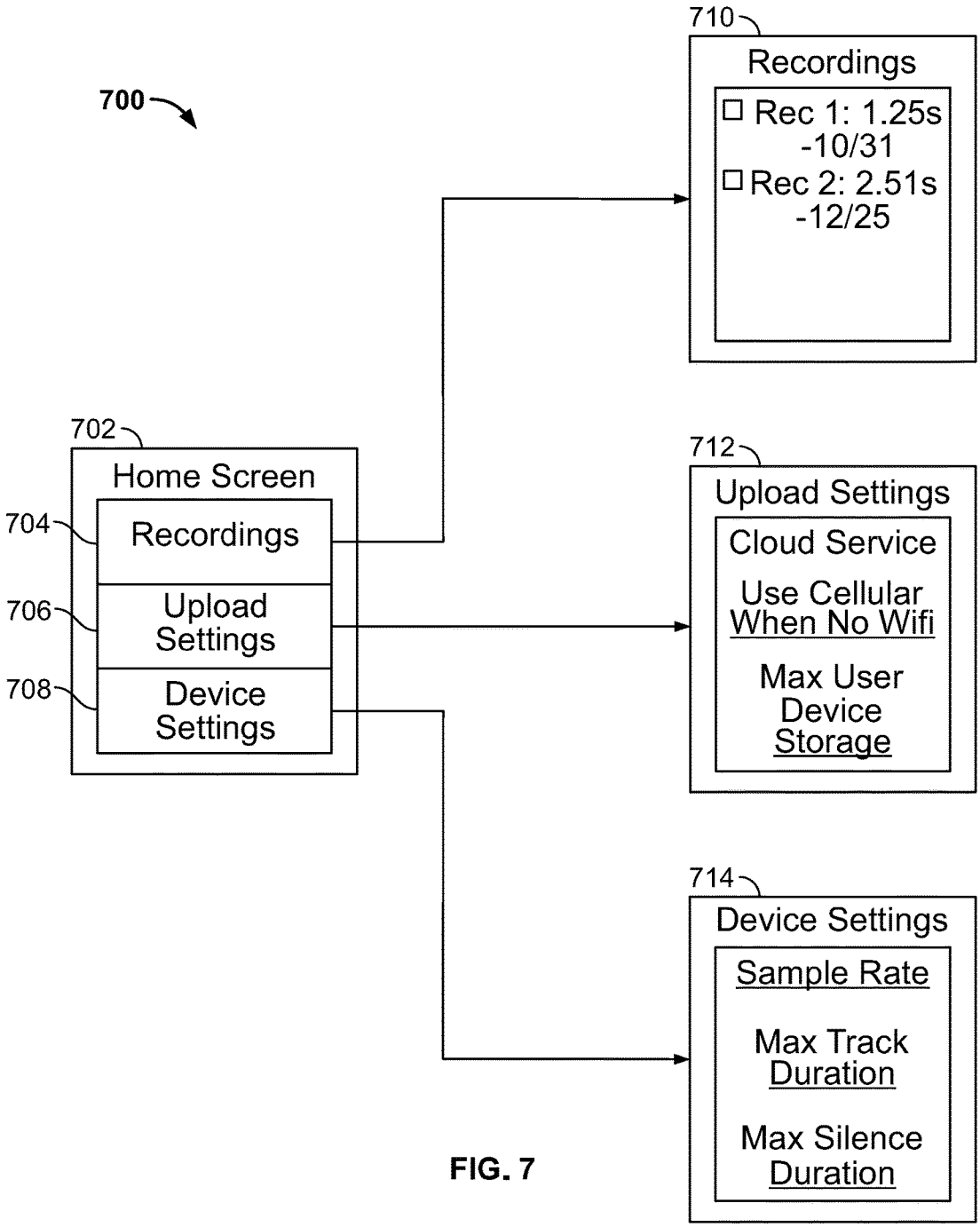
FIG. 7 is a diagram illustrating user interface screens generated by the user device including a home screen, a recording listing screen, an upload settings screen, and a device settings screen.

FIG. 7 illustrates additional user interface screens, indicated generally at 700, of the MIDI application 306. An example of a home screen of the MIDI application 306 is illustrated in 702. The home screen has three selectable buttons, a recordings button 704, an upload settings button 706, and a device settings button 708. The buttons can be selected by a user via, for example, a touchscreen of the user device 108. The recordings button will open the recordings screen, indicated generally at 710. The recordings screen includes a list of recordings (e.g., audio data and/or MIDI data) received from the recorder 104. The recordings can include metadata, including a date, a time, a duration, a label (e.g., name, genre, etc.), a format type, etc. The upload settings button will open the upload settings screen, indicated generally at 712. The upload settings screen includes multiple user device 108 settings, such as, for example, to which cloud service the audio data and MIDI data are uploaded to, whether to use cellular data to upload the audio data and the MIDI data when no WiFi network is available, and the maximum data storage allowed on the user device 108. The device settings button will open the device settings screen, indicated generally at 714. The device settings screen can include multiple recorder 104 settings, such as, for example, a sample rate, a maximum track duration, a maximum silence duration, a duration until the MIDI data is recorded as a new track, etc.

It should be understood that the above description in connection with FIG. 7 sets forth examples, and that the MIDI application 306 can have any number of functions or combinations of functions either discussed above or generally related to user device applications/programs.

Figure 8:
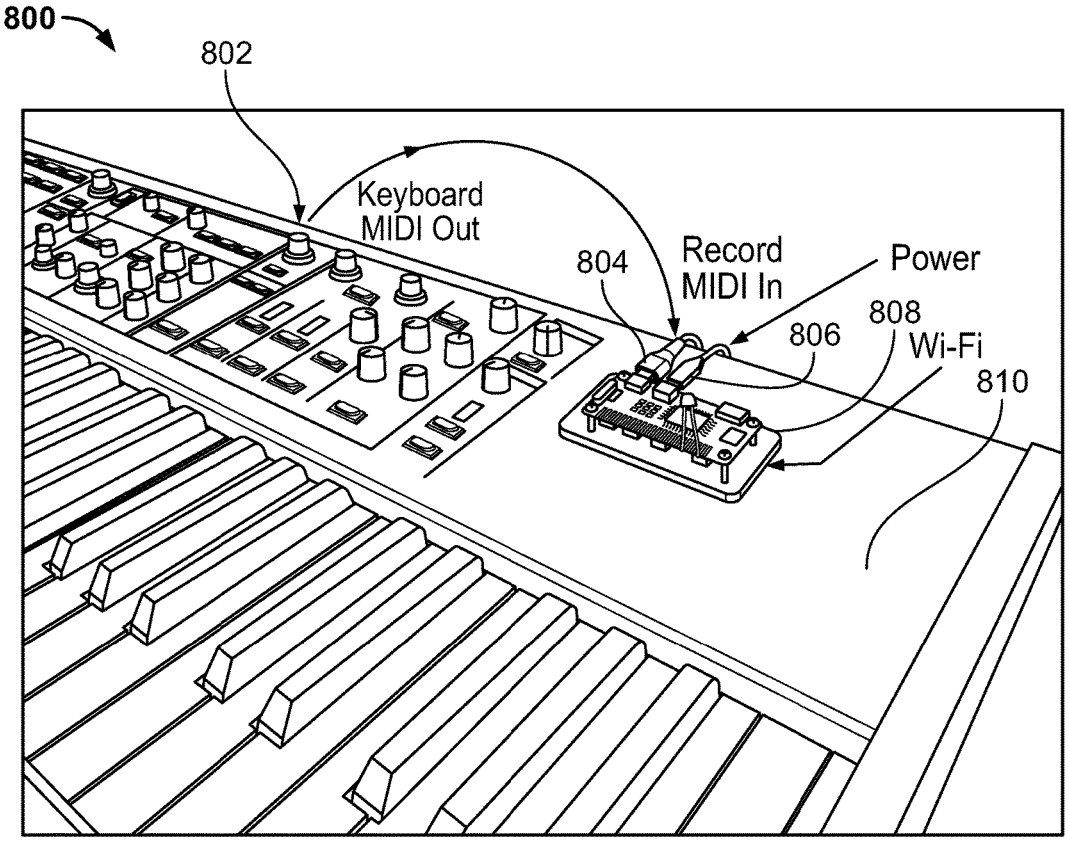
FIG. 8 a is a photo showing various connections of the recorder, including connection to a MIDI keyboard as well as power and wireless connections to the recorder.

FIG. 8 is a photo 800 illustrating connection of the recorder 808 to an instrument 810. The instrument 810 has a keyboard MIDI out port 802. The keyboard MIDI out port 802 is connected to a MIDI in port 804 of the recorder 808 via a MIDI cable. A power cable 806 is also connected to the recorder 808. The recorder 808 can record MIDI data from the instrument 810, using the methods discussed above, and transmit the MIDI data and audio data to a user device via, for example, a WiFi connection.

Figure 9:
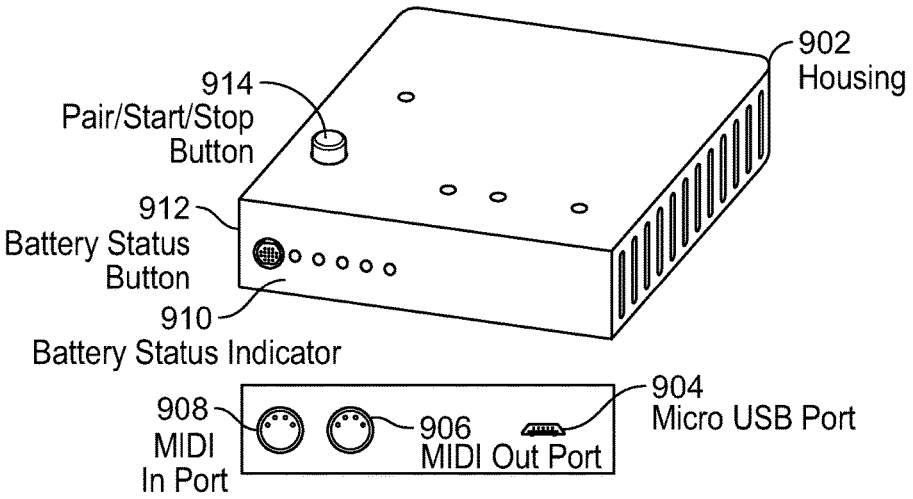
FIG. 9 is a diagram illustrating a housing and external components of the recorder.

FIG. 9 illustrates construction of a housing 902 and external components for the recorder. The housing 902 could contain all of the components of the recorder (e.g., the components shown in FIG. 2), and could be approximately three inches in length, three inches in width and 0.75 inches in height. Of course, other dimensions are possible. The housing 902 can house a rechargeable, lithium-polymer battery which can be charged via a micro USB port 904. The micro USB port 904 can be further used to transfer data, such as audio data or MIDI data, from or to the recorder. The housing 902 further includes a MIDI out port 906 and a MIDI in port 908. The MIDI in port 908 can receive MIDI data from an instrument via a MIDI cable. The MIDI out port 906 can transmit the MIDI data to a further device via a MIDI cable, such as a sound system. The housing 902 further includes a set of LEDs to indicate a battery status 910, a button 912 to display the battery status, and a button 914 to pair the recorder to a user device, and to start and/or stop a track. Those skilled in the art would understand that any combination of buttons can be used. For example, the recorder can have two buttons to perform the functions of button 914, where a first button can pair the recorder to a user device and a second button can start/stop a track. Those skilled in the art would further understand that any assortment of LEDs can be used to indicate other statuses, such as but not limited to, low memory, strong or weak signal, etc.

Having thus described the system and method in detail, it is to be understood that the foregoing description is not intended to limit the spirit or scope thereof. It will be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure. What is intended to be protected by Letters Patent is set forth in the following claims.

What is claimed is:

1. A method for recording audio from an instrument, comprising the steps of:

receiving musical instrument digital interface ("MIDI") data from an instrument at a recorder in communication with the instrument;

recording the MIDI data onto a first memory of the recorder;

rendering the MIDI data into an audio file at the recorder;

storing the audio file onto a second memory of the recorder as stored data; and transmitting the stored data to at least one of a user device or a cloud-based storage system.

2. The method of claim 1, wherein the step of rendering the MIDI data into an audio file is performed when a break in a stream of MIDI data from the instrument occurs or when a predetermined track duration is exceeded.

3. The method of claim 2, wherein the break has a predetermined or a user-defined duration.

4. The method of claim 1, wherein the stored data is transmitted from the recorder to the user device via a WiFi connection, a Bluetooth connection, or a cellular connection.

5. The method of claim 1, wherein the first memory is a volatile memory and the second memory is a non-volatile memory.

6. The method of claim 1, further comprising storing the MIDI data onto the second memory as the stored data.

7. The method of claim 1, wherein the stored data further comprises metadata.

8. The method of claim 1, further comprising clearing the first memory after the audio data is stored onto the second memory.

9. The method of claim 1, wherein the step of transmitting the stored data to the user device occurs upon a request from the user device.

10. The method of claim 1, wherein the step of transmitting the stored data to the user device or the cloud-based storage system occurs upon a pairing with the user device.

11. The method of claim 1, wherein the user device is a smartphone, a tablet or a computer.

12. The method of claim 1, further comprising receiving an instruction from the user device and changing a parameter or a setting of the MIDI device based on the instruction.

13. The method of claim 12, wherein the parameter or the setting comprises one of a sample rate, a maximum track duration, a maximum silence duration, or a duration until the MIDI data is recorded as a new track.

14. A recorder for use with a musical instrument, comprising:

a processor;

a transceiver in communication with the processor;

a first memory in communication with the processor; and a second memory in communication with the processor, the processor receiving MIDI data from the musical instrument, recording the MIDI data onto the first memory, rendering the MIDI data into an audio file, storing the audio data onto the second memory as stored data, and transmitting the stored data, via the transceiver, to at least one of a user device or a cloud-based storage system.

15. The recorder of claim 14, wherein the transceiver is one of a cellular transceiver, a Bluetooth transceiver or a WiFi transceiver.

16. The recorder of claim 14, wherein the first memory is a volatile memory and the second memory is a non-volatile memory.

17. The recorder of claim 14, wherein the processor renders the MIDI data into the audio file when a break in a stream of MIDI data from the instrument occurs or when a predetermined track duration is exceeded.

18. The recorder of claim 14, wherein the processor clears the first memory after the audio data is stored onto the second memory.

19. The recorder of claim 14, wherein the processor receives an instruction from the user device and changes a parameter or a setting of the device based on the instruction.

20. The recorder of claim 19, wherein the parameter or the setting comprises one of a sample rate, a maximum track duration, a maximum silence duration, or a duration until the MIDI data is recorded as a new track.

* * * * *